US006846250B2

(12) United States Patent
Higuchi et al.

(10) Patent No.: US 6,846,250 B2
(45) Date of Patent: Jan. 25, 2005

(54) SOLID GOLF BALL

(75) Inventors: Hiroshi Higuchi, Chichibu (JP); Hirotaka Shimosaka, Chichibu (JP); Junji Umezawa, Chichibu (JP); Yasushi Ichikawa, Chichibu (JP); Rinya Takesue, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 10/801,841

(22) Filed: Mar. 17, 2004

(65) Prior Publication Data

US 2004/0176190 A1 Sep. 9, 2004

Related U.S. Application Data

(63) Continuation of application No. 10/022,384, filed on Dec. 20, 2001, now Pat. No. 6,746,347.

(30) Foreign Application Priority Data

Dec. 22, 2000 (JP) ..... 2000-389759

(51) Int. Cl.[7] ..... A63B 37/06
(52) U.S. Cl. ..... 473/378
(58) Field of Search ..... 473/351, 374, 473/378, 371, 368

(56) References Cited

U.S. PATENT DOCUMENTS

| | | | | |
|---|---|---|---|---|
| 4,919,434 A | | 4/1990 | Saito | |
| 5,314,187 A | | 5/1994 | Proudfit | |
| 5,553,852 A | | 9/1996 | Higuchi et al. | |
| 5,779,563 A | | 7/1998 | Yamagishi et al. | |
| 5,816,944 A | | 10/1998 | Asakura et al. | |
| 5,899,822 A | * | 5/1999 | Yamagishi et al. | 473/374 |
| 5,957,784 A | | 9/1999 | Asakura et al. | |
| 5,994,470 A | * | 11/1999 | Tanaka et al. | 525/183 |
| 6,015,356 A | | 1/2000 | Sullivan et al. | |
| 6,071,201 A | | 6/2000 | Maruko | |
| 6,142,888 A | | 11/2000 | Higuchi et al. | |
| 6,162,135 A | | 12/2000 | Bulpett et al. | |
| 6,174,247 B1 | | 1/2001 | Higuchi et al. | |
| 6,267,692 B1 | | 7/2001 | Higuchi et al. | |
| 6,746,347 B2 | * | 6/2004 | Higuchi et al. | 473/378 |

FOREIGN PATENT DOCUMENTS

| | | |
|---|---|---|
| GB | 2-278-609 A | 12/1994 |
| GB | 2-342-295 A | 4/2000 |
| JP | 2000-157647 | 6/2000 |

* cited by examiner

*Primary Examiner*—Raeann Gorden
(74) *Attorney, Agent, or Firm*—Sughrue Mion, PLLC

(57) ABSTRACT

In a solid golf ball comprising an elastic solid core and a resin cover, the cover has a JIS-C hardness of 50–85, and provided that the ball receives a spin rate S1 (rpm) in the dry state and a spin rate S2 (rpm) in the wet state when hit with a short iron having a loft of an 8-iron or greater, the percent spin retention: (S2/S1)×100 is at least 47%. The ball's spin susceptibility when hit with the short iron is not reduced in the dry state or fine weather, nor is noticeably reduced even in the wet state or rain weather. The ball has so high performance that the ball travels a distance as intended, immediately stops on the green, is easy to control and thus, suited for professional and amateur low-handicap golfers.

3 Claims, 1 Drawing Sheet

SOLID GOLF BALL

This is a continuation of application Ser. No. 10/022,384 filed Dec. 20, 2001 now U.S. Pat. No. 6,746,347; the disclosure of which is incorporated herein by reference.

This invention relates to a solid golf ball comprising an elastic solid core and a resin cover of at least one layer enclosing the solid core, and more particularly, to a solid golf ball which prevents substantial reduction of spin when hit in the wet state with a short iron. As used herein, the term "wet state" refers to the state of a golf course in rain weather, and the term "dry state" refers to the state of a golf course in fine weather.

BACKGROUND OF THE INVENTION

One of known solid golf balls has the structure in which a rubbery elastic solid core is enclosed with a cover of relatively hard ionomer resin characterized by good external damage prevention such as cut resistance and abrasion resistance.

The golf ball of this structure performs well in the dry state or fine weather in that it travels a satisfactory distance when hit with a driver and receives a requisite spin when hit with an iron which demands controllability to the ball. In the wet state or rain weather, however, the ball becomes less susceptible to spin and therefore, becomes less controllable when hit with an iron club. In particular, the spin susceptibility of the ball when hit with a short iron having a loft of an 8-iron or greater is degraded. As a result, the ball will travel a longer distance than intended or will not stop immediately on the green, about which professional and low-handicap golfers complain. It is desired to overcome the above problem.

SUMMARY OF THE INVENTION

Therefore, an object of the invention is to provide a solid golf ball comprising an elastic solid core and a resin cover of at least one layer, which ball is easy to control on short iron shots because, with respect to the spin the ball receives when hit with a short iron, the percent retention of the spin in the wet state from the spin in the dry state is high.

According to the invention, there is provided a solid golf ball comprising an elastic solid core and a resin cover of at least one layer enclosing the solid core. The cover has a JIS-C hardness of up to 85. The percent spin retention given by (S2/S1)×100 is at least 47%, provided that the ball receives a spin rate S2 (rpm) in the dry state and a spin rate S2 (rpm) in the wet state when hit with a short iron having a loft of an 8-iron or greater.

In one preferred embodiment, the cover is composed of a plurality of layers including inner and outer layers, the cover outer layer has a JIS-C hardness of up to 85, the cover inner layer has a JIS-C hardness of at least 55, and the JIS-C hardness of the cover outer layer is lower than that of the cover inner layer.

Preferably, the cover or the cover outer layer has a flexural rigidity of up to 196 MPa (2000 kgf/cm$^2$). Also preferably, the cover or the cover outer layer has a flexural rigidity A (kgf/cm$^2$) and a JIS-C hardness B, A and B satisfy the relationship:

$$A \geqq 300+0.37\times e^{(0.098\times B)}$$

wherein e is the base of natural logarithm.

In the preferred embodiment wherein the cover is composed of a plurality of layers including inner and outer layers, an adhesive layer intervenes between the cover inner and outer layers.

The invention ensures that the spin susceptibility of the ball when hit with a short iron having a loft of an 8-iron or greater is not reduced in the dry state or fine weather, nor is noticeably reduced even in the wet state or rain weather. Then the ball travels a distance as intended, immediately stops on the green, and is easy to control. This is a high-performance solid golf ball suited for professional and amateur low-handicap golfers to play with.

DESCRIPTION OF THE PREFERRED EMBODIMENT

Figure 1:
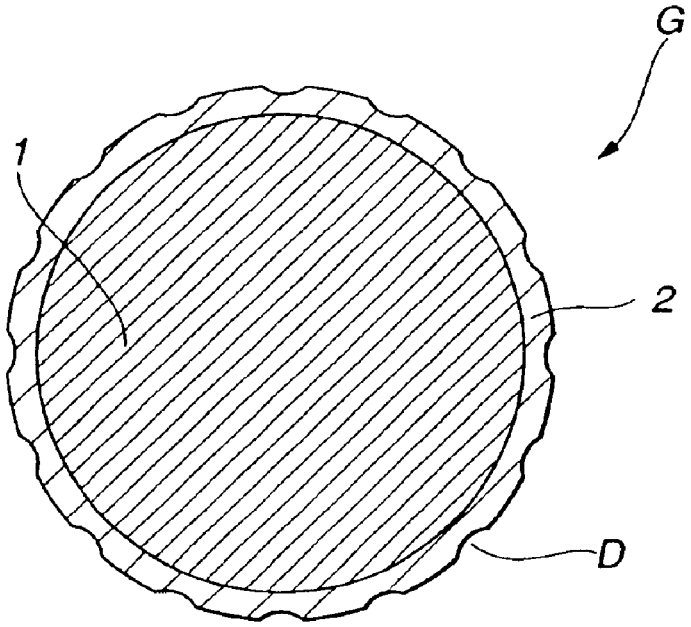
FIG. 1 is a cross-sectional view of a solid golf ball according to one embodiment of the invention.
Figure 2:
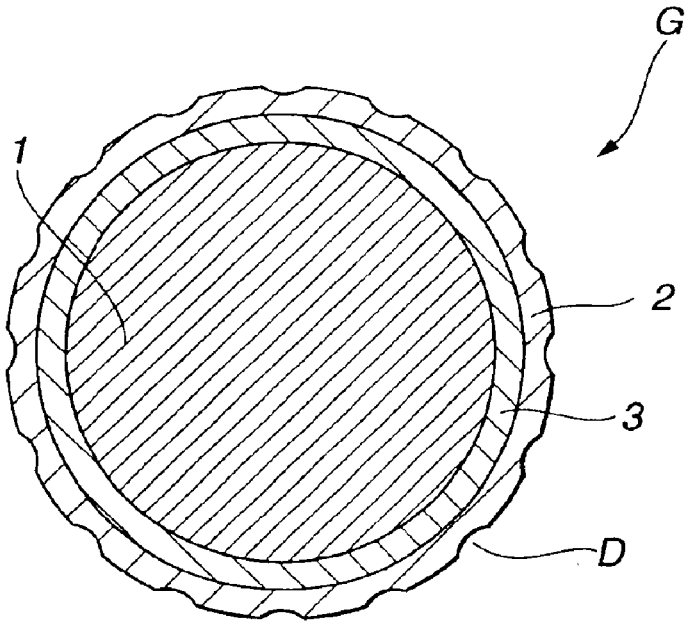
FIG. 2 is a cross-sectional view of a solid golf ball according to another embodiment of the invention.

The solid golf ball of the invention is embodied in FIG. 1 as comprising a solid core 1 and a cover 2 enclosing the core 1 or in FIG. 2 as comprising a solid core 1, a cover inner layer 3 enclosing the core 1, and a cover outer layer 2 enclosing the inner layer 3, all in a concentric manner. The cover inner layer 3 is a single layer in the illustrated embodiment although it may be composed of two or more layers. It is noted that the cover is provided on the outer surface with a multiplicity of dimples D.

The solid core 1 is preferably formed of a rubber composition, which is preferably based on polybutadiene. The preferred polybutadiene is cis-1,4-polybutadiene having at least 40% of cis configuration. In the base rubber, polybutadiene is compounded with another rubber such as natural rubber, polyisoprene rubber or styrene-butadiene rubber if desired. Increasing the rubber content leads to golf balls with improved rebound.

In the rubber composition, there may be blended a crosslinking agent, for example, zinc and magnesium salts of unsaturated fatty acids such as zinc dimethacrylate and zinc diacrylate and esters such as trimethylpropane methacrylate. Zinc diacrylate is especially preferred. The crosslinking agent is preferably used in an amount of at least about 10 parts and up to about 50 parts by weight, and especially at least about 20 parts and up to about 45 parts by weight per 100 parts by weight of the base rubber.

A vulcanizing agent is generally blended in the rubber composition. It is recommended that the vulcanizing agent include a peroxide having a 1-minute half-life temperature of not higher than 155° C., the content of the peroxide being at least 30% by weight, and especially at least 40% by weight, of the overall vulcanizing agent. No particular upper limit is imposed on the content of peroxide, although this content is preferably not more than 70% by weight. Examples of suitable peroxides include commercially available products such as Perhexa 3M (manufactured by NOF Corp.). The amount of vulcanizing agent blended in the rubber composition is preferably set at about 0.6 to about 2 parts by weight per 100 parts by weight of the base rubber.

If necessary, other suitable ingredients may also be added to the rubber composition, including antioxidants and specific gravity-adjusting fillers such as zinc oxide and barium sulfate.

The solid core can be prepared from the above-described rubber composition. For example, after the components are kneaded in a conventional mixer such as a Banbury mixer or roll mill, the kneaded material is compression or injection molded in a core-forming mold where it is heated to a sufficient temperature for the crosslinking and vulcanizing agents to work, thereby effecting vulcanization or cure. In one example where dicumyl peroxide is used as the vulcanizing agent and zinc diacrylate used as the crosslinking agent, the material is heated at about 130 to about 170° C. for about 10 to 40 minutes, and especially at about 150 to about 160° C. for about 12 to 20 minutes.

As noted above, the solid core is prepared from the rubber composition by well-known molding and vulcanizing or curing techniques. The solid core typically has a diameter of at least 30 mm, more preferably at least 33 mm, even more preferably at least 35 mm and up to 40 mm, more preferably up to 39 mm, even more preferably up to 38 mm. Also preferably the solid core has a specific gravity of at least 1.0, more preferably at least 1.05, even more preferably at least 1.1 and up to 1.3, more preferably up to 1.25, even more preferably up to 1.2. Further preferably, the solid core has a deflection under an applied load of 981 N (100 kgf) of at least 2.2 mm, more preferably at least 2.5 mm, even more preferably at least 2.8 mm, most preferably at least 3.1 mm and up to 6.0 mm, more preferably up to 5.5 mm, even more preferably up to 5.0 mm, most preferably up to 4.5 mm. The core has a hardness (JIS-C hardness) distribution in cross section which may be leveled or graded between the center and the outer surface or may locally vary (local hardness difference).

The solid core may have either a single-layer structure formed of one material or a multi-layer structure of two or more concentric layers of different materials.

The cover 2 enclosing the solid core 1 is constructed to at least one layer. One embodiment of the invention is a two-piece solid golf ball G having a cover consisting of a single layer as shown in FIG. 1, wherein the cover should have a JIS-C hardness of up to 85.

The cover may be formed of a thermoplastic polyurethane elastomer, thermosetting polyurethane elastomer, polyester elastomer, polyamide elastomer, a blend of polyester elastomer and ionomer resin in a weight ratio between 100/0 and 60/40, a composition based on a thermoplastic polyurethane elastomer prepared using an aromatic or aliphatic isocyanate, a composition based on the reaction product of the thermoplastic polyurethane elastomer with an isocyanate compound, or the like.

The thermoplastic polyurethane elastomer has a molecular structure including soft segments of a high molecular weight polyol and hard segments constructed of a monomolecular chain extender and a diisocyanate. The high molecular weight polyol compounds used herein include, though are not limited thereto, polyester polyols, polyether polyols, copolyester polyols, and polycarbonate polyols. The polyester polyols include polycaprolactone glycol, poly (ethylene-1,4-adipate) glycol, and poly(butylene-1,4-adipate) glycol. Typical of the copolyester polyols is poly (diethylene glycol adipate) glycol. One exemplary polycarbonate polyol is (hexanediol-1,6-carbonate) glycol. Polyoxytetramethylene glycol is typical of the polyether polyols. These polyols have a number average molecular weight of about 600 to 5,000, preferably about 1,000 to 3,000. The chain extender used herein may be any of commonly used polyhydric alcohols and amines. Examples include 1,4-butylene glycol, 1,2-ethylene glycol, 1,3-propylene glycol, 1,6-hexylene glycol, 1,3-butylene glycol, dicyclohexylmethylmethane diamine (hydrogenated MDA), and isophorone diamine (IPDA). The diisocyanates used herein are preferably aliphatic diisocyanates and aromatic diisocyanates. Exemplary aliphatic diisocyanates include hexamethylene diisocyanate (HDI), 2,2,4- or 2,4,4-trimethylhexamethylene diisocyanate (TMDI), and lysine diisocyanate (LDI). Exemplary aromatic diisocyanates include 2,4-toluene diisocyanate, 2,6-toluene diisocyanate, and 4,4-diphenylmethane diisocyanate. Of these, aliphatic diisocyanates are preferred from the standpoint of the cover's yellowing resistance, and HDI is most preferable because of compatibility in blending with other resins.

Of the thermoplastic polyurethane elastomers, those elastomers which on viscoelasticity measurement, exhibit a tan δ peak temperature of −15° C. or lower, more preferably −16° C. or lower, with the lower limit being −50° C. or higher, are preferred from the flexibility and resilience standpoint. Such thermoplastic polyurethane elastomers are commercially available under the trade name of Pandex T7298 (−20° C.), T7295 (−26° C.), and T7890 (−30° C.) from Bayer DIC Polymer Co., Ltd. in which the diisocyanate is aliphatic. It is noted that the temperature in parentheses indicates the tan δ peak temperature.

As the cover material, the reaction product of the above-described thermoplastic polyurethane elastomer with an isocyanate compound may also be used because it can further improve the surface durability of the cover against iron shots.

The isocyanate compound used herein may be any of isocyanate compounds used in conventional polyurethanes. Exemplary aromatic isocyanate compounds include 2,4-toluene diisocyanate, 2,6-toluene diisocyanate or a mixture thereof, 4,4-diphenylmethane diisocyanate, m-phenylene diisocyanate, and 4,4'-biphenyl diisocyanate. Hydrogenated products of these aromatic isocyanate compounds, for example, dicyclohexylmethane diisocyanate are also useful. Also included are aliphatic isocyanates such as tetramethylene diisocyanate, hexamethylene diisocyanate (HDI) and octamethylene diisocyanate as well as alicyclic diisocyanates such as xylene diisocyanate. Other useful examples include blocked isocyanate compounds obtained by reacting a compound having at least two isocyanate groups at the end with a compound having active hydrogen, and uretidione forms resulting from isocyanate dimerization.

An appropriate amount of the isocyanate compound used is generally at least 0.1 part, preferably at least 0.2 part, more preferably at least 0.3 part by weight and up to 10 parts, preferably up to 5 parts, more preferably up to 3 parts by weight, per 100 parts by weight of the thermoplastic polyurethane elastomer. Too small an amount of the isocyanate compound may fail to induce sufficient crosslinking reaction, with little improvements in physical properties being observed. Too large an amount may give rise to several problems including substantial discoloration by aging, heat and ultraviolet radiation, the loss of thermoplasticity and a decline of resilience.

The thermosetting polyurethane of which the cover is made is obtained from a polyisocyanate such as 2,4-toluene diisocyanate (TDI), methylenebis(4-cyclohexyl isocyanate) (HMDI), 4,4'-diphenylmethane diisocyanate (MDI) or 3,3'-dimethyl-4,4'-biphenylene diisocyanate (TODI) and a polyol which will cure with a polyamine such as methylene dianiline (MDA), a trihydric glycol such as trimethylol propane or a tetrahydric glycol such as N,N,N',N'-tetrakis (2-hydroxy-propyl)ethylene diamine.

Preferred polyether polyols are polytetramethylene ether glycol, poly(oxypropylene) glycol and polybutadiene glycol. Preferred polyester polyols are polyethylene adipate glycol, polyethylene propylene adipate glycol and polybutylene adipate glycol. Preferred polylactone polyols are diethylene glycol-initiated caprolactone, 1,4-butane-diol-initiated caprolactone, trimethylol propane-initiated caprolactone and neopentyl glycol-initiated caprolactone. Of these polyols, preferred are polytetramethylene ether glycol, polyethylene adipate glycol, polybutylene adipate glycol and diethylene glycol-initiated caprolactone.

A suitable curing agent is selected from slow-reactive polyamines such as 3,5-dimethylthio-2,4-toluenediamine, 3,5-dimethylthio-2,6-toluenediamine, N,N'-dialkyldiamino-diphenylmethanes, trimethylene glycol di-p-aminobenzoate, polytetramethylene oxide di-p-aminobenzoate, dihydric glycols, and mixtures thereof. It is noted that 3,5-dimethylthio-2,4-toluenediamine and 3,5-dimethylthio-2,6-toluenediamine are isomers and commercially available under the trade name of ETHACURE® 300 from Ethyl Corporation; trimethylene glycol di-p-aminobenzoate and polytetramethylene oxide di-p-aminobenzoate are available under the trade name of POLACURE 740M and POLAMINES, respectively, from Polaroid; and N,N'-dialkyldiamino-diphenylmethane is available under the trade name of UNILINK® from UOP.

Preferred glycol is PTMEG or poly(tetramethylene ether) glycol.

Preferred dihydric glycols are 1,4-butanediol, 1,3-butanediol, 2,3-butanediol, 2,3-dimethyl-2,3-butanediol, dipropylene glycol and ethylene glycol. The dihydric glycols are essentially slow reactive.

As noted above, the thermosetting polyurethanes can be prepared from a number of commercially available aromatic, aliphatic and alicyclic diisocyanates and polyisocyanates.

The thermoplastic polyester elastomers of which the cover is made are multi-block copolymers of the polyether ester family which are synthesized from terephthalic acid, 1,4-butanediol, polytetramethylene glycol (PTMG) and polypropylene glycol (PPG) and therefore, comprise hard segments of polybutylene terephthalate (PBT) and soft segments of polytetramethylene glycol (PTMG) and polypropylene glycol (PPG). They are commercially available as Hytrel 3078, 4047, G3548W, 4767 and 5577 from Dupont Toray Co., Ltd.

The polyamide elastomers of which the cover is made are multi-block copolymers of the polyamide family which comprise hard segments of a nylon oligomer such as nylon 6, 11 or 12 and soft segments of polytetramethylene glycol (PTMG) or polypropylene glycol (PPG). They are commercially available as Pebax 2533, 3533 and 4033 from Elf Atochem.

These cover materials may be used alone or in admixture. Blends of each of the foregoing resins with an ionomer resin are also useful. If necessary, well-known additives such as pigments, dispersants, antioxidants, UV absorbers and plasticizers may be blended in the cover material.

The cover should have a JIS-C hardness of up to 85, preferably up to 80, more preferably up to 75, and even more preferably up to 73. The lower limit of JIS-C hardness is preferably at least 50, more preferably at least 55, even more preferably at least 60, and most preferably at least 63. The cover with too low a JIS-C hardness may lead to too much spin and a reduced flight distance. Too high a JIS-C hardness suppresses spin to an extremely low rate to decline controllability and reduces the spin consistency between dry and wet state shots.

The cover should preferably have a flexural rigidity of up to 196 MPa (2000 kgf/cm$^2$), more preferably up to 157 MPa (1600 kgf/cm$^2$), even more preferably up to 127 MPa (1300 kgf/cm$^2$), and most preferably up to 98 MPa (1000 kgf/cm$^2$). The lower limit of flexural rigidity is preferably at least 39 MPa (400 kgf/cm$^2$), more preferably at least 59 MPa (600 kgf/cm$^2$), even more preferably at least 69 MPa (700 kgf/cm$^2$), and most preferably at least 78 MPa (800 kgf/cm$^2$).

In a preferred embodiment, provided that the cover has a flexural rigidity A (kgf/cm$^2$) and a JIS-C hardness B, A and B satisfy the relationship:

$$A \geqq 300+0.37\times e^{(0.098\times B)}$$

wherein e is the base of natural logarithm (=2.718 . . . ). Outside this range, there may arise problems such as a decline of flight distance and a loss of spin control.

The cover should preferably have a specific gravity of at least 0.9, more preferably at least 1.0, even more preferably at least 1.05 and most preferably at least 1.1 and up to 1.3, more preferably up to 1.25, even more preferably up to 1.22 and most preferably up to 1.19. The cover preferably has a gage or radial thickness of at least 0.5 mm, more preferably at least 0.7 mm, even more preferably at least 0.9 mm and most preferably at least 1.1 mm and up to 3.0 mm, more preferably up to 2.5 mm, even more preferably up to 2.2 mm and most preferably up to 2.0 mm.

Any desired technique may be used to enclose the solid core with the cover. Use may be made of conventional injection molding and compression molding techniques.

The other preferred embodiment of the invention is a three-piece solid golf ball G shown in FIG. 2 as having the cover consisting of two layers, inner layer 3 and outer layer 2. In this embodiment, the cover outer layer is preferably made of the same material as the cover of the two-piece solid golf ball described above, to a JIS-C hardness of up to 85, and softer than the cover inner layer.

The cover inner layer is preferably formed of a material based on a resin component such as an ionomer resin or a blend of an ionomer resin with an olefin elastomer. Also useful are blends of an ionomer resin with a polyester elastomer, ionomer resins having an increased degree of neutralization, and ionomer resins having an increased acid content.

The blend of an ionomer resin with an olefin elastomer exhibits better properties (e.g., hitting feel and rebound) which cannot be arrived at using the components alone. Examples of the olefin elastomer include linear low-density polyethylene, low-density polyethylene, high-density polyethylene, polypropylene, rubber-reinforced olefin polymers, flexomers, plastomers, thermoplastic elastomers containing acid-modified ones (e.g., styrene base block copolymers and hydrogenated polybutadiene-ethylene-propylene rubber), dynamically vulcanized elastomers, ethylene acrylate, and ethylene vinyl acetate. Commercially available products include HPR from Dupont-Mitsui Polychemicals Co., Ltd. and Dynaron from JSR Corporation. The weight ratio of the ionomer resin to the olefin elastomer is preferably from 40:60 to 95:5, more preferably from 45:55 to 90:10, even more preferably from 48:52 to 88:12, and most preferably from 55:45 to 85:15. Too low a proportion of the olefin elastomer may often lead to a hard feel whereas too high a proportion thereof may lead to a decline of resilience.

The ionomer resins which can be used herein are of the neutralized type with such ions as Zn, Mg, Na and Li. An ionomer resin material is recommended comprising 5 to 100%, more preferably 10 to 80%, most preferably 15 to 70% by weight of a Zn or Mg ion-neutralized type ionomer resin which is relatively flexible and resilient. The ionomer resin may be blended with another polymer as long as it does not compromise the benefits of the invention.

The cover inner layer may also be formed of a blend of an ionomer resin with a polyester elastomer. The weight ratio of the ionomer resin to the polyester elastomer is preferably from 40:60 to 95:5, more preferably from 45:55 to 90:10, even more preferably from 48:52 to 88:12, and most preferably from 55:45 to 85:15. Too low a proportion of the polyester elastomer may often lead to a hard feel whereas too high a proportion thereof may lead to a decline of resilience.

Also, the cover inner layer may be formed of a material comprising an ionomer resin, a fatty acid or derivative thereof having a molecular weight of at least 280, and a basic inorganic metal compound capable of neutralizing acid groups in the foregoing components, which are heated and mixed so that the degree of neutralization of acid groups on the ionomer resin is increased. Moreover, an ionomer resin having an increased acid content, such as Himilan AM7317 and AM7318 from Dupont-Mitsui Polychemicals Co., Ltd. may be used to form the cover inner layer.

It is preferred that the material of which the cover inner layer is made contain less than about 30%, especially 1 to 20% by weight of an inorganic filler such as zinc oxide, barium sulfate and titanium dioxide.

The cover inner layer should preferably have a JIS-C hardness of at least 55, more preferably at least 60, even more preferably at least 65, further preferably at least 70, and most preferably at least 75 and up to 99, more preferably up to 96, even more preferably up to 94, further more preferably up to 92, and most preferably up to 90. The JIS-C hardness of the cover inner layer is preferably higher than that of the cover outer layer.

The cover inner layer should preferably have a specific gravity of at least 0.8, more preferably at least 0.9, even more preferably at least 0.92 and most preferably at least 0.93 and up to 1.2, more preferably up to 1.16, even more preferably up to 1.1 and most preferably up to 1.05.

The cover inner layer preferably has a gage or radial thickness of at least 0.5 mm, more preferably at least 0.7 mm, even more preferably at least 0.9 mm and up to 3.0 mm, more preferably up to 2.5 mm, even more preferably up to 2.0 mm. The cover outer layer preferably has a gage or radial thickness of at least 0.5 mm, more preferably at least 0.7 mm, even more preferably at least 0.9 mm, most preferably at least 1.1 mm and up to 3.0 mm, more preferably up to 2.5 mm, even more preferably up to 2.2 mm, most preferably up to 2.0 mm.

Any desired technique may be used to enclose the solid core with the cover inner layer. Use may be made of conventional injection molding and compression molding techniques.

In one preferred embodiment, an adhesive layer intervenes between the cover inner layer and the cover outer layer for the purpose of improving the durability against strikes. As the adhesive, epoxy resin base adhesives, vinyl resin base adhesives, and rubber base adhesives may be used although urethane resin base adhesives and chlorinated polyolefin base adhesives are preferred.

Dispersion coating may be used to form the adhesive layer. The type of emulsion which is used in dispersion coating is not critical. The resin powder used in preparing the emulsion may be either thermoplastic resin powder or thermosetting resin powder. Exemplary resins are vinyl acetate resins, vinyl acetate copolymer resins, EVA (ethylene-vinyl acetate copolymer resins), acrylate (co) polymer resins, epoxy resins, thermosetting urethane resins, and thermoplastic urethane resins. Of these, epoxy resins, thermosetting urethane resins, thermoplastic urethane resins, and acrylate (co)polymer resins are preferred, with the thermoplastic urethane resins being most appropriate.

Preferably the adhesive layer has a gage of 0.1 to 30 $\mu$m, more preferably 0.2 to 25 $\mu$m, and even more preferably 0.3 to 20 $\mu$m.

The solid golf ball thus constructed should have spin consistency between the dry state and the wet state. Provided that the ball receives a spin rate S1 (rpm) in the dry state when hit with a short iron having a loft of an 8-iron or greater and the ball receives a spin rate S2 (rpm) in the wet state when hit with the same short iron, the invention requires that the percent spin retention given by (S2/S1)×100 be at least 47%, preferably at least 48%, more preferably at least 49%, even more preferably at least 50%, and most preferably at least 51%. If the percent spin retention [(S2/S1)×100] is less than 47%, the difference in spin rate between the dry state and the wet state is too large to accomplish the desired consistent spin control effect and leads to noticeable variations in flight distance or carry, failing to achieve the objects and advantages of the invention. As noted in the preamble, the "dry state" refers to the state of a golf course in normal conditions such as in fine weather, and the "wet state" refers to the state of a golf course in rain weather or when the lawn is dewed, specifically the state that the golf ball surface is wetted with water.

The solid golf ball of the invention is generally provided on its surface with a multiplicity of, typically about 360 to about 540, evenly arranged dimples of two or more types which differ in diameter and/or depth. For the arrangement of dimples, any well-known technique may be used, and no particular limit is imposed as long as the dimples are evenly distributed. There may be employed any of the octahedral arrangement, icosahedral arrangement, and sphere division techniques of equally dividing a hemisphere into 2 to 6 regions wherein dimples are distributed in the divided regions. Fine adjustments or modifications may be made on these techniques.

The diameter and weight of the golf ball of the invention comply with the Rules of Golf. The ball is formed to a diameter of not less than 42.67 mm and preferably up to 44 mm, more preferably up to 43.5 mm, even more preferably up to 43 mm. The weight is not greater than 45.92 g and preferably at least 44.5 g, more preferably at least 44.8 g, even more preferably at least 45 g, and most preferably at least 45.1 g.

EXAMPLE

Examples and Comparative Examples are given below for illustrating the invention, but the invention is not limited to the following Examples.

Examples & Comparative Examples

Using the formulations shown in Tables 1 to 4, two- and three-piece solid golf balls as reported in Tables 5 and 6 were prepared by a conventional process.

TABLE 1

| Solid core composition (pbw) | ① | ② | ③ | ④ | ⑤ | ⑥ | ⑦ |
|---|---|---|---|---|---|---|---|
| Polybutadiene | 100 | 100 | 100 | 100 | 100 | 100 | 100 |
| Dicumyl peroxide | 1.2 | 1.2 | 1.2 | 1.2 | 1.2 | 1.2 | 1.2 |
| Barium sulfate | 11.7 | 13.9 | 17.4 | 11.3 | 19.5 | 12.2 | 14.9 |
| Zinc white | 5 | 5 | 5 | 5 | 5 | 5 | 5 |
| Antioxidant | 0.2 | 0.2 | 0.2 | 0.2 | 0.2 | 0.2 | 0.2 |
| Zinc salt of pentachlorothiophenol | 1 | 1 | 1 | 1 | 1 | 1 | 1 |
| Zinc diacrylate | 27 | 26 | 24 | 31 | 27 | 27 | 30 |

TABLE 3-continued

| Cover inner layer (pbw) | a | b | c | d | e | f | g |
|---|---|---|---|---|---|---|---|
| Himilan 1557 | | | | | 50 | | |
| Himilan 1601 | | | | | 50 | | |
| Himilan AM7317 | 50 | | 40 | | | | |
| Himilan AM7318 | 50 | | 40 | | | | |
| Surlyn 9945 | | | | 35 | | | |
| Surlyn 8945 | | | | 35 | | | |
| Behenic acid | | 20 | | | | | |
| Calcium hydroxide | | 3 | | | | | |
| Hytrel 4047 | | | | | | | 100 |
| Dynaron 6100P | | | 20 | 30 | | | |
| Titanium dioxide | 5.1 | 2 | 5.1 | 5.1 | 5.1 | 5.1 | |

Note that the amount of each additive is per 100 parts by weight of the resin components combined.

TABLE 4

| Cover outer layer (pbw) | A | B | C | D | E | F | G | H | I | J |
|---|---|---|---|---|---|---|---|---|---|---|
| Hytrel 4701 | 100 | | | | | | | | | |
| Hytrel 4047 | | | 80 | | 55 | | 70 | | | |
| Pandex TR3080 | | 30 | | 20 | | 50 | | | | |
| Pandex T7295 | | 70 | | | | 50 | | | | |
| Pandex 6098 | | | | 80 | | | | 100 | | |
| Himilan 1706 | | | 10 | | 22.5 | | 15 | | | 50 |
| Himilan 1605 | | | 10 | | 22.5 | | 15 | | | 50 |
| Surlyn 7930 | | | | | | | | | 37 | |
| Surlyn AD8542 | | | | | | | | | 40 | |
| Nucrel AN4318 | | | | | | | | | 23 | |
| Titanium dioxide | 5.1 | 2.7 | 5.1 | 2.7 | 5.1 | 2.7 | 5.1 | 2.7 | 5.1 | 5.1 |
| Dicyclohexylmethane diisocyanate | | 1.5 | | 1.5 | | 1.5 | | | | |

Note that the amount of each additive is per 100 parts by weight of the resin components combined.
Pandex: thermoplastic polyurethane elastomers by Bayer-DIC Polymer Co., Ltd.
Nucrel: ethylene-methacrylic acid-acrylate copolymer and ethylene-methacrylic acid copolymer by Dupont-Mitsui Polychemicals Co., Ltd.
Himilan: ionomer resins by Dupont-Mitsui Polychemicals Co., Ltd.
Dynaron: hydrogenated polybutadiene by JSR Corp.
Surlyn: ionomer resins by E.I. Dupont
Hytrel: thermoplastic polyester elastomers by Toray-Dupont Co., Ltd.
Dicyclohexylmethane diisocyanate: by Bayer-Sumitomo Urethane Industry Co., Ltd.

TABLE 2

| Solid core composition (pbw) | ⑧ | ⑨ | ⑩ | ⑪ | ⑫ |
|---|---|---|---|---|---|
| Polybutadiene | 100 | 100 | 100 | 100 | 100 |
| Dicumyl peroxide | 1.2 | 1.2 | 1.2 | 1.2 | 1.2 |
| Barium sulfate | 12.2 | 4.0 | 21.5 | 13.6 | 20.7 |
| Zinc white | 5 | 5 | 5 | 5 | 5 |
| Antioxidant | 0.2 | 0.2 | 0.2 | 0.2 | 0.2 |
| Zinc salt of pentachlorothiophenol | 1 | 1 | 1 | 1 | 1 |
| Zinc diacrylate | 26 | 30 | 37 | 34 | 26 |

Note:
Polybutadiene: JSR BR11 by JSR Corp.
Dicumyl peroxide: Percumyl D by NOF Corp.
Antioxidant: Nocrack NS6 by Ouchi Shinko Kagaku K. K.

TABLE 3

| Cover inner layer (pbw) | a | b | c | d | e | f | g |
|---|---|---|---|---|---|---|---|
| Nucrel AN4318 | | 15 | | | | | |
| Himilan 1706 | | 42.5 | | | | 50 | |
| Himilan 1605 | | 42.5 | | | | 50 | |

A flight test was carried out on each of the thus prepared golf balls by the following method. Also, the spin and carry of the ball in the dry and wet states when hit with No. 9 iron (#I9) were determined, from which a percent spin retention (S2/S1×100%) and a carry difference (m) were calculated. Further, the ball was hit with a sand wedge (#SW) for approach shot to examine the spin performance and stop on the green. The results are shown in Tables 5 and 6.

Flight Test

Using a swing robot of Miyamae K.K., twenty balls of each Example were hit with a driver (#W1) at a head speed (HS) of 50 m/s.

Club used

Head: manufactured by Bridgestone Sports Co., Ltd., J's METAL, loft angle 7.50°, lie angle 57°, SUS630 stainless steel, lost wax process Shaft: Harmotech Pro, HM-70, LK (low kick point), hardness X With respect to driver flight performance, the ball was rated "◎" for excellent, "O" for good, "Δ" for fair, and "X" for poor performance.

Spin

The ball was hit with No. 9 iron (#I9) at a head speed (HS) of 34 m/s, both in the dry state (humidity 40%) and in the wet state (the club face and the ball were wetted with water).

The behavior of the ball immediately after impact was captured by photography, and the spin rate was calculated from image analysis.

by photography, and the spin rate was calculated from image analysis. The distance over which the ball rolled to stop after landing on the green was measured.

TABLE 5

| | | Example | | | | | | |
|---|---|---|---|---|---|---|---|---|
| | | 1 | 2 | 3 | 4 | 5 | 6 | 7 |
| Core | Type | ① | ② | ③ | ④ | ⑤ | ⑥ | ⑦ |
| | Outer diameter (mm) | 36.4 | 36.4 | 36.4 | 36.4 | 36.4 | 37.0 | 37.0 |
| | Deflection under 100 kg (mm) | 3.8 | 4.0 | 4.2 | 3.3 | 3.8 | 3.8 | 3.5 |
| Cover inner layer | Type | a | b | c | d | d | e | f |
| | JIS-C hardness | 92 | 86 | 86 | 82 | 82 | 86 | 88 |
| | Specific gravity | 0.98 | 0.96 | 0.97 | 0.96 | 0.96 | 0.98 | 0.98 |
| | Gage (mm) | 1.7 | 1.7 | 1.7 | 1.7 | 1.7 | 1.7 | 1.7 |
| Adhesive layer | | present | present | present | present | absent | present | absent |
| Cover outer layer | Type | A | B | C | D | E | F | G |
| | JIS-C hardness | 71 | 71 | 69 | 75 | 75 | 69 | 71 |
| | Specific gravity | 1.19 | 1.18 | 1.12 | 1.18 | 1.07 | 1.18 | 1.10 |
| | Gage (mm) | 1.5 | 1.5 | 1.5 | 1.5 | 1.5 | 1.2 | 1.2 |
| | Flexural rigidity ($kg/cm^2$) | 890 | 880 | 850 | 1020 | 980 | 850 | 890 |
| Ball | Weight (g) | 45.3 | 45.3 | 45.3 | 45.3 | 45.3 | 45.3 | 45.3 |
| | Outer diameter (mm) | 42.7 | 42.7 | 42.7 | 42.7 | 42.7 | 42.7 | 42.7 |
| #W1/HS50 flight performance | | ○ | ○ | ○ | ○ | ○ | ○ | ○ |
| #I9/HS34 | Dry spin S1 (rpm) | 8730 | 8800 | 9610 | 9200 | 9170 | 9500 | 8820 |
| | Dry carry (m) | 122.0 | 121.0 | 120.5 | 122.5 | 122.0 | 121.0 | 121.5 |
| | Wet spin S2 (rpm) | 4680 | 4750 | 4660 | 4950 | 4920 | 4650 | 4760 |
| | Wet carry (m) | 130.0 | 130.0 | 130.5 | 129.0 | 129.0 | 130.0 | 130.0 |
| | Spin retention S2/S1 (%) | 54 | 54 | 48 | 54 | 54 | 49 | 54 |
| | Carry difference (wet-dry) | 8.0 | 9.0 | 10.0 | 6.5 | 7.0 | 9.0 | 8.5 |
| #SW/HS20 | Spin (rpm) | 6250 | 6220 | 6390 | 6130 | 6080 | 6420 | 6260 |
| | Stop-on-green (m) | 6.5 | 6.6 | 5.8 | 6.8 | 7.0 | 5.5 | 6.6 |

TABLE 6

| | | Example | | Comparative Example | | | |
|---|---|---|---|---|---|---|---|
| | | 8 | 9 | 1 | 2 | 3 | 4 |
| Core | Type | ⑧ | ⑨ | ⑩ | ⑪ | ⑫ | wound golf ball |
| | Outer diameter (mm) | 38.9 | 38.9 | 36.0 | 38.9 | 35.3 | |
| | Deflection under 100 kg (mm) | 4.0 | 3.5 | 2.5 | 2.9 | 4.0 | |
| Cover inner layer | Type | | | e | | g | |
| | JIS-C hardness | | | 86 | | 64 | |
| | Specific gravity | | | 0.98 | | 1.12 | |
| | Gage (mm) | | | 1.8 | | 1.8 | |
| Adhesive layer | | | | present | | absent | |
| Cover outer layer | Type | E | H | I | I | J | |
| | JIS-C hardness | 75 | 78 | 75 | 75 | 88 | |
| | Specific gravity | 1.07 | 1.18 | 0.98 | 0.98 | 0.98 | |
| | Gage (mm) | 1.9 | 1.9 | 1.6 | 1.9 | 2.0 | |
| | Flexural rigidity ($kg/cm^2$) | 980 | 1100 | 580 | 580 | 2160 | |
| Ball | Weight (g) | 45.3 | 45.3 | 45.3 | 45.3 | 45.3 | |
| | Outer diameter (mm) | 42.7 | 42.7 | 42.7 | 42.7 | 42.7 | |
| #W1/HS50 flight performance | | Δ | Δ | ○ | ○ | ◎ | X |
| #I9/HS34 | Dry spin S1 (rpm) | 9450 | 9220 | 9250 | 9190 | 8380 | 9880 |
| | Dry carry (m) | 120.5 | 121.5 | 119.0 | 120.5 | 121.5 | 119.5 |
| | Wet spin S2 (rpm) | 4900 | 4690 | 4150 | 4120 | 2520 | 4570 |
| | Wet carry (m) | 128.5 | 131.0 | 134.0 | 134.5 | 138.0 | 130.0 |
| | Spin retention S2/S1 (%) | 52 | 51 | 45 | 45 | 30 | 46 |
| | Carry difference (wet-dry) | 8.0 | 9.5 | 15.0 | 14.0 | 16.5 | 10.5 |
| #SW/HS20 | Spin (rpm) | 6150 | 6200 | 6210 | 5830 | 4420 | 6040 |
| | Stop-on-green (m) | 6.7 | 6.6 | 6.6 | 7.3 | 8.2 | 7.1 |

Approach Test

Using the swing robot, ten balls of each example were hit with a sand wedge (#SW, Classical Edition by Bridgestone Sports Co., Ltd.) at a head speed (HS) of 20 m/s. The behavior of the ball immediately after impact was captured There has been described a high-performance solid golf ball whose spin susceptibility when hit with a short iron having a loft of an 8-iron or greater is not reduced in the dry state or fine weather, nor is reduced even in the wet state or rain weather, so that the ball travels a distance as intended, immediately stops on the green, is easy to control and thus, suited for professional and amateur low-handicap golfers to play with.

Japanese Patent Application No. 2000-389759 is incorporated herein by reference.

Although some preferred embodiments have been described, many modifications and variations may be made thereto in the light of the above teachings. It is therefore to be understood that within the scope of the appended claims, the invention may be practiced otherwise than as specifically described.

What is claimed is:

1. A two-piece solid golf ball composed of an elastic solid core and a resin cover enclosing the solid core, said cover having a JIS-C hardness of up to 85, and having a flexural rigidity of 78 (800 kgf/cm2) to 196 MPa (2000 kgf/cm2), wherein said cover is formed of a composition based on the reaction product of the thermoplastic polyurethane elastomer with an isocyanate compound and the isocyanate compound is selected from a group of aromatic isocyanate compounds, hydrogenated products of aromatic isocyanate compounds, aliphatic isocyanates and alicyclic diisocyanates, and the isocyanate compound used is at least 0.2 part by weight and up to 5 parts by weight, per 100 parts by weight of the thermoplastic polyurethane elastomer, and wherein provided that the ball receives a spin rate S1 (rpm) in the dry state and a spin rate S2 (rpm) in the wet state when hit with a short iron having a loft of an 8-iron or greater, the percent spin retention given by (S2/S1)×100 is at least 47%.

2. The solid golf ball of claim 1, wherein said isocyanate compound is dicyclohexylmethane diisocyanate.

3. The solid golf ball of claim 1 wherein said cover has a flexural rigidity A (kgf/cm2) and a JIS-C hardness B, A and B satisfy the relationship:

$$A \geqq 300+0.37\times e(o.\ 098XB)$$

wherein e is the base of natural logarithm.

* * * * *